United States Patent [19]

Lin et al.

[11] Patent Number: 4,831,687

[45] Date of Patent: May 23, 1989

[54] DOOR CLOSER WITH A CONCEALED MOUNTING

[75] Inventors: San-I Lin, Yunlin; Ching-Chuan Kuo, Chiayi, both of Taiwan

[73] Assignee: Tong Lung Metal Industry Co., Ltd., Chiayi City, Taiwan

[21] Appl. No.: 97,015

[22] Filed: Sep. 16, 1987

[51] Int. Cl.[4] ..... E05F 3/00; E05F 1/00

[52] U.S. Cl. ..... 16/49; 16/71

[58] Field of Search ..... 16/49, 51, 66, DIG. 9, 16/DIG. 10, 70, 71, 80, 65; 248/DIG. 6, 223.3, 223.4, 224.1, 224.2

[56] References Cited

U.S. PATENT DOCUMENTS

| | | | |
|---|---|---|---|
| 2,271,928 | 2/1942 | Sims | 248/224.4 |
| 2,440,867 | 5/1948 | Marchand | 248/224.2 |
| 3,188,682 | 6/1965 | Check et al. | 16/49 |
| 3,928,894 | 12/1975 | Bury et al. | 248/223.4 X |
| 4,086,681 | 5/1978 | Nakanishi | 16/49 |

FOREIGN PATENT DOCUMENTS

| | | | |
|---|---|---|---|
| 164448 | 10/1905 | Fed. Rep. of Germany | 248/224.2 |
| 756210 | 8/1956 | United Kingdom | 16/49 |

*Primary Examiner*—Nicholas P. Godici
*Assistant Examiner*—Carmine Cuda
*Attorney, Agent, or Firm*—Sughrue, Mion, Zinn, Macpeak & Seas

[57] ABSTRACT

A door closer includes a plate-shaped mounting bracket and a closer body. The bracket is secured to a door. The closer body is secured detachably to the bracket by a particular tongue and groove engagement and a fastener. The closer body has an opening which is sized so that the bracket can be completely concealed by the closer body. After the fastener is removed, the closer body can slide within the bracket. The closer body has two opposed side walls each having an inner surface which has longitudinally spaced-apart grooves. The bracket body has two opposed sides on each of which spaced-apart tongues are provided for engaging with the grooves. The closer body can be sleeved on the bracket and then moved laterally relative to the bracket so as to achieve the tongue and groove engagement.

5 Claims, 11 Drawing Sheets

DOOR CLOSER WITH A CONCEALED MOUNTING

BACKGROUND OF THE INVENTION

The present invention relates to a door closer, and more particularly to one which has an improved mounting.

A door closer is mounted on a door for applying a torque to return the door to a closed position. Conventional mountings for door closers may be classified into three types. One is with the two end lugs which are integrally formed with the closer body, as shown in FIG. 1, and which have holes for screwing the closer body to the door. This type of mounting has the drawbacks of unsightly appearance and increasing material. Another type, as shown in FIG. 2, is that of elongated bolts passing through the closer body for screwing the closer body to the door, causing bolt-mounting part of the door to bear excessive torque. When used for a long time, it is easy to damage the bolt-mounting part. The third type, as shown in FIG. 3, includes a dovetail mounting bracket screwed to the door, and a dovetail groove formed in the closer body for engaging with the dovetail mounting bracket. The dovetail tongue and groove engagement has been disclosed in several U.S. patents, for example, U.S. Pat. Nos. 3,188,682 to M. M. Check et al., 3,252,178 to M. M. Check et al., and 4,086,681 to Nakanishi.

In M. M. Check's door closer, after the completion of engaging the dovetail tongue with the dovetail groove, to fix the closer body on the mounting bracket, the interengaging tapered surfaces between the dovetail tongue of the mounting bracket and the dovetail groove of the closer body are forced against each other by a complicated adjustment, e.g. by adjusting a cylindrical cam member with a draw bolt.

In Nakanishi's door closer, after the engagement of the dovetail tongue and the dovetail groove is completed, the closer body is secured to the mounting bracket by an elongated bolt. Then, by inserting a cover plate of a trapezoid cross-section into another dovetail groove of the closer body provided in the side remote from the mounting bracket, the head of the elongated bolt is concealed by the cover plate.

These dovetail tongues have two end surfaces which are exposed and are thus unsightly. In addition, their operation of securing the closer body to the mounting bracket is not very easy.

SUMMARY OF THE INVENTION

It is therefore an object of the present invention to provide a door closer of the type having a mounting bracket in which the mounting bracket is completely concealed by the closer body to improve appearance of the door closer.

It is therefore another object of the present invention to provide a door closer of the type having a mounting bracket in which the door closer can be easily secured detachably to the mounting bracket by a particular tongue and groove engagement.

According to the present invention, the door closer includes a plate-shaped mounting bracket adapted to be fixed on the door, and a closer body secured detachably to the bracket and having a housing which has an opening for receiving the bracket therein.

The bracket is smaller than the opening of the closer body in size so as to be completely concealed by the closer body. In construction, the bracket has two opposed first sides and two opposed second sides interconnecting the first sides. Each of the first sides having tongues which are longitudinally spaced apart from each other and which extend inwardly and laterally relative to the housing, the tongues having straight end edges which extend in a predetermined direction. One of the first sides and second sides has a first fastener hole.

The closer body has two opposed first side walls and two opposed second side walls interconnecting the first side walls, in which each of the first side walls has longitudinally spaced-apart inwardly projecting surfaces. Any adjacent two of the projecting surfaces define a space which is sufficiently large to allow access of the corresponding tongue. Each of the projecting surfaces having a groove which extends in the predetermined direction to communicate with the corresponding space and which is well-matched with the end edge of the corresponding tongue. One of the first and second side walls is adjacent to the first fastener hole and includes a first fastener and a second fastener hole which is aligned with the first fastener hole for securing the closer body to the bracket by the first fastener.

BRIEF DESCRIPTION OF THE DRAWINGS

Other features and advantages of the present invention will become apparent from the following description of the preferred embodiments of the present invention with reference to the accompanying drawings in which.

DETAILED DESCRIPTION OF THE PREFERRED EMBODIMENTS

Figure 1:
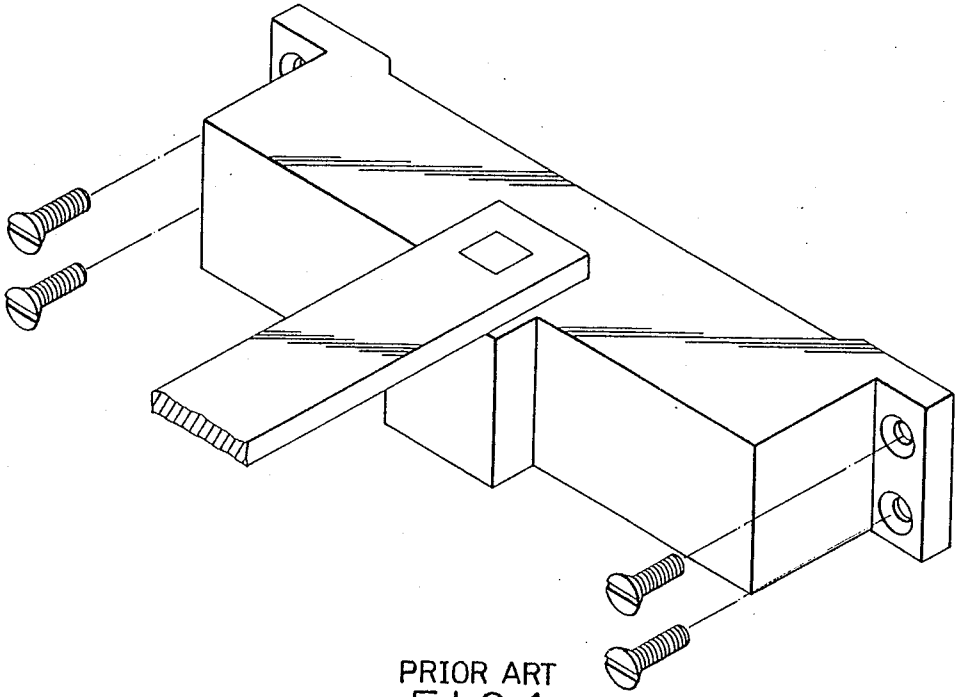
PRIOR ART FIG. 1
FIG. 1 is a schematic view illustrating the method of mounting a first type of conventional door closer onto a door.
Figure 2:
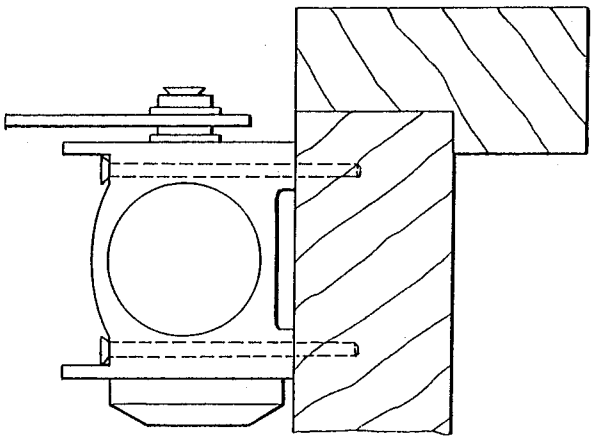
PRIOR ART FIG. 2
FIG. 2 is a schematic view illustrating the method of mounting a second type of conventional door closer onto a door.
Figure 3:
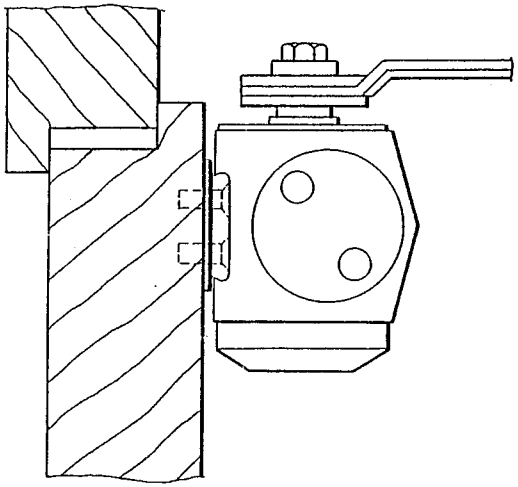
PRIOR ART FIG. 3
FIG. 3 is a schematic view illustrating the method of mounting a third type of conventional door closer onto a door.
Figure 4:
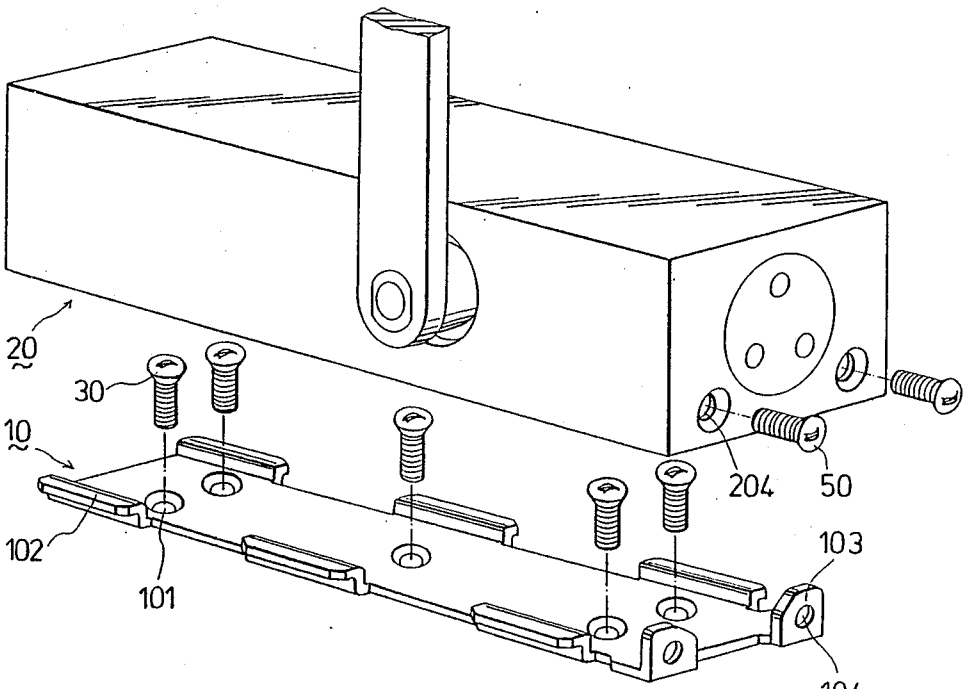
FIG. 4 is an exploded perspective view showing a door closer according to a first embodiment of the present invention.
Figure 5:
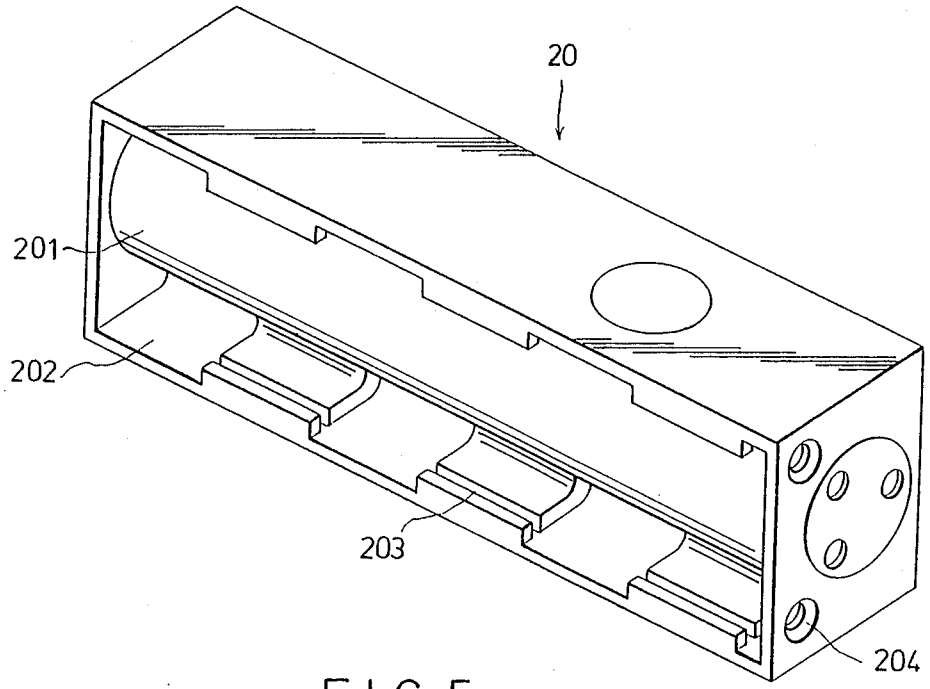
FIG. 5 is a perspective view showing the inside of a closer body of the door closer according to the first embodiment of the present invention.
Figure 6:
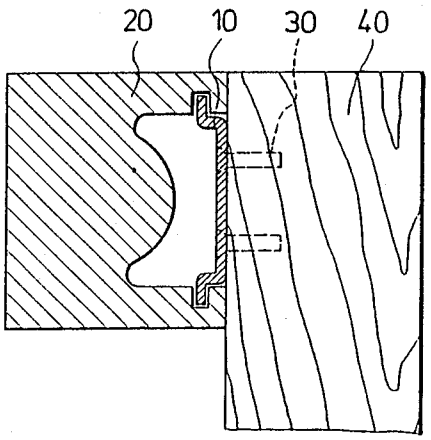
FIG. 6 is an assembled sectional view showing the door closer according to the first embodiment of the present invention, viewed from a short side of the closer body.
Figure 7:
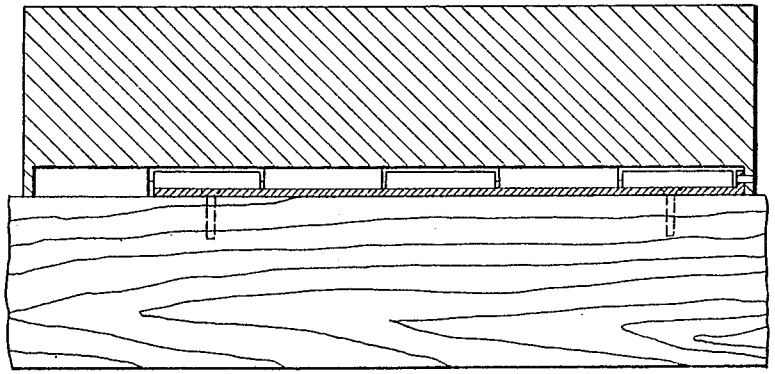
FIG. 7 is an assembled sectional view showing the door closer according to the first embodiment of the present invention, viewed from a long side of the closer body.

Referring to FIGS. 4 through 7, there is shown a door closer according to the present invention. The door closer includes a plate-shaped mounting bracket 10 and a closer body 20.

The bracket 10 has five holes 101 for being secured to a door 40 by bolts 30. The bracket 10 is generally rectangular and thus includes two opposed long sides, from each of which three L-shaped tongues 102 project, the tongues 102 being in line with one another and spaced apart at the same distance, and two opposed short sides, on one of which two lugs 103 are provided. Each of the lugs 103 has a screw hole 104 therein.

The closer body 20 has at the side adjacent to the door 40 an opening 201 which is greater than the bracket 10 in size for completely receiving the bracket 10 while permitting the bracket 10 to slide within the opening 201 along the length of the closer body 20. Thus, the bracket 10 can be completely concealed by the closer body 20 to enhance the appearance of the door closer.

Each long side wall of the closer body 20 is formed with three equally spaced-apart projecting surfaces, between any adjacent two of which a rectangular recess 202 is formed. The width of recesses 202 is slightly greater than that of the tongues 102 thereby allowing for access of the tongues 102. Each of the projecting surfaces has an open-ended rectangular groove 203. The grooves 203 are in line with one another for engaging with the tongues 102 while enabling the tongues 102 to slide along the grooves 203. One short side wall of the closer body 20 is formed with a pair of holes 204 which are aligned with the screw holes 104 of the lugs 103 respectively for securing the closer body 20 to the bracket 10 by bolts 50. The relative sliding movement between the closer body 20 and the bracket 10 is therefore prevented.

In assembly, the bracket 10 is first screwed to the door 40 by the bolts 30. The closer body 20 is then sleeved on the bracket 10 so that the tongues 102 are inserted into the recesses 202 respectively. When the end surface of the closer body 20 abuts against the door 40, the ends of the tongues 102 are aligned with the grooves 203. After the closer body 20 has been positioned on the bracket 10, the closer body 20 is slid along the long sides of the bracket 10 until the closer body 20 is obstructed by the lugs 103 from sliding movement. The closer body 20 is then secured to the bracket 10 by engaging the bolts 50 through the holes 204 of the closer body 20 and the screw holes 104 of the lugs 103. Accordingly, the closer body 20 can be easily secured to the bracket 10. Also, when the closer is malfunctioning, the closer body 20 can be easily separated from the bracket 10 for servicing.

Figure 8:
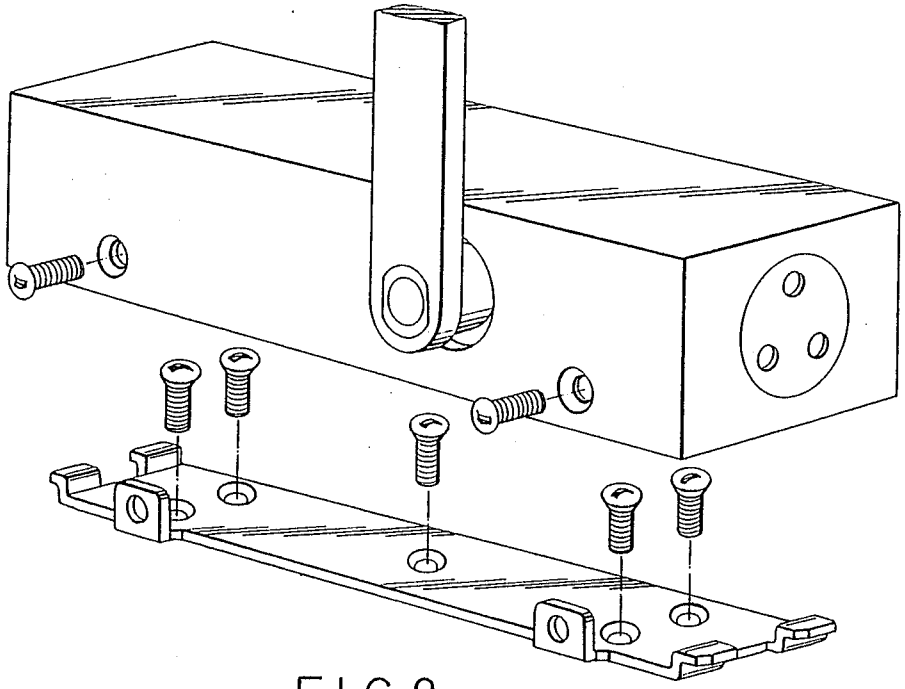
FIG. 8 is an exploded perspective view showing a door closer according to a second embodiment of the present invention.
Figure 9:
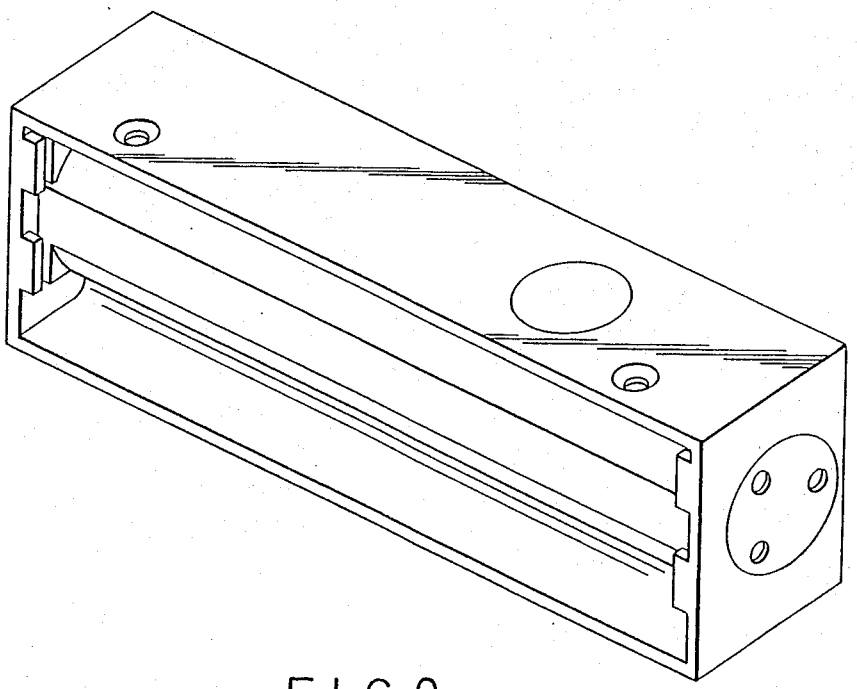
FIG. 9 is a perspective view showing the inside of a closer body of the door closer according to the second embodiment of the present invention.
Figure 10:
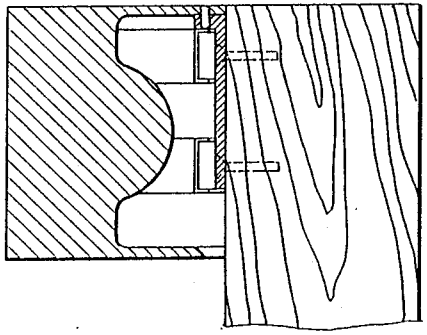
FIG. 10 is an assembled sectional view showing the door closer according to the second embodiment of the present invention, viewed from a short side of the closer body.
Figure 11:
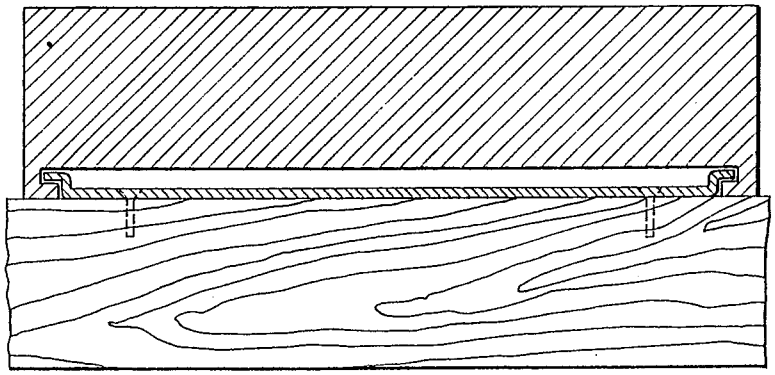
FIG. 11 is an assembled sectional view showing the door closer according to the second embodiment of the present invention, viewed from a long side of the closer body.

As a way of modification to the first embodiment of the present invention, referring to FIGS. 8 through 11, the tongues 102 may be provided on the short sides of the bracket 10 and the lugs 103 may be provided on one long side of the bracket 10. At this time, the number of the tongues 102 is preferably reduced to two, as shown in FIG. 8. Certainly, the structure of the closer body 20 must be correspondingly changed into that shown in FIG. 9 to incorporate with the bracket 10.

Figure 12:
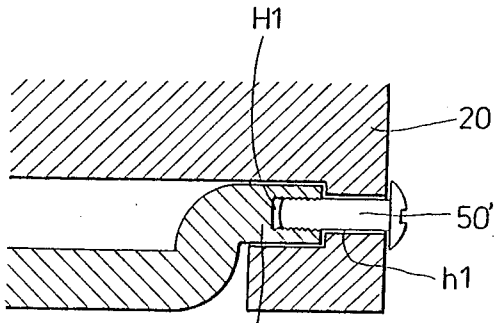
FIGS. 12 and 13 are schematic views illustrating two alternative methods of locking a closer body on a mounting bracket by screwing a lock bolt through a wall of the closer body into a threaded hole provided in a tongue of the mounting bracket in accordance with the present invention.
Figure 13:
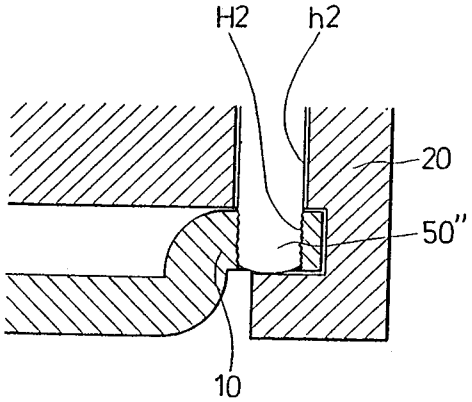
Figure 14:
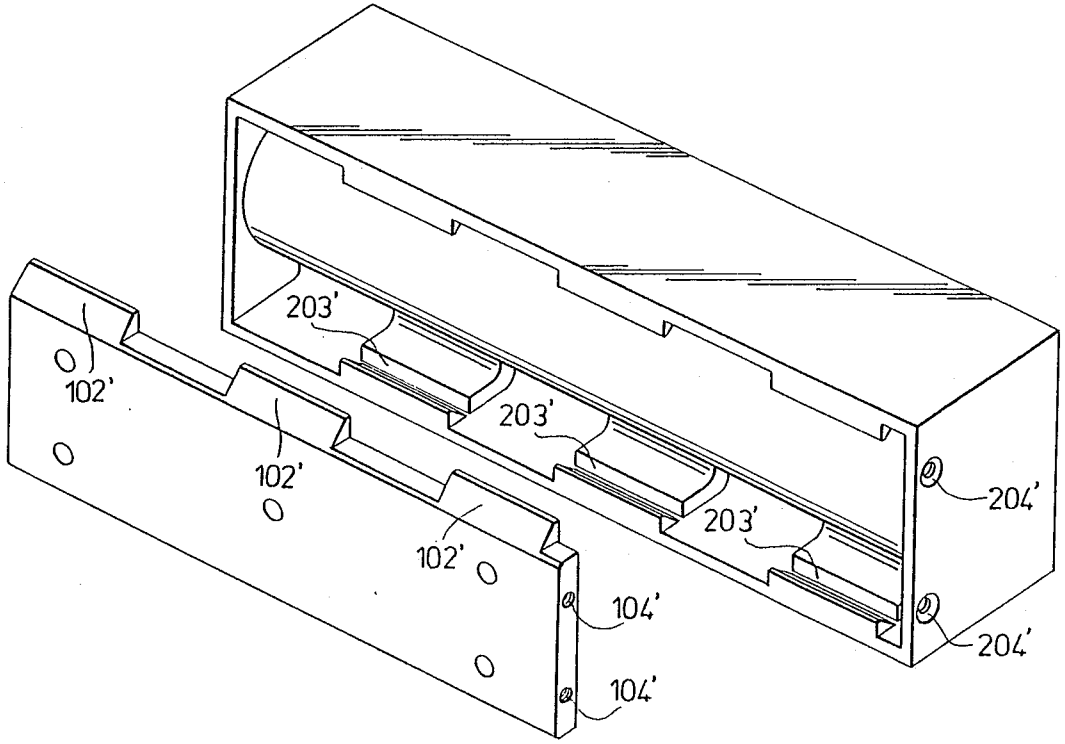
FIG. 14 is an exploded perspective view showing a door closer according to a third embodiment of the present invention.
Figure 15:
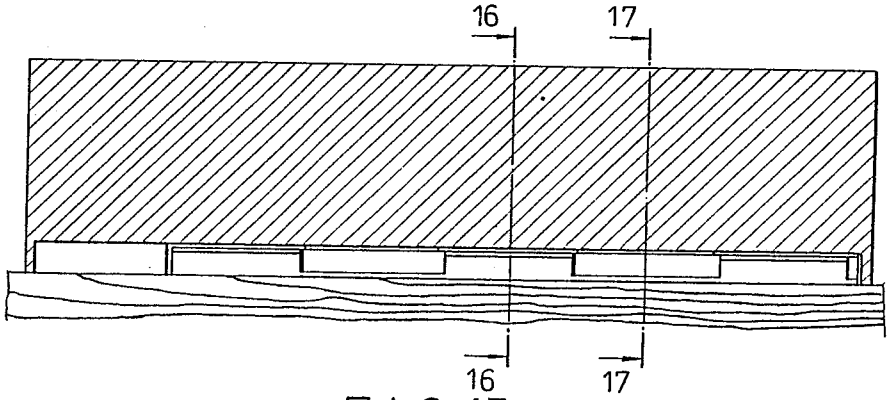
FIG. 15 is a sectional view showing the door closer according to the third embodiment of the present invention, viewed from a long side of its closer body.
Figure 16:
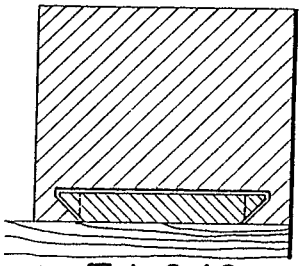
FIG. 16 is a sectional view taken along the line 16—16 of FIG. 15.
Figure 17:
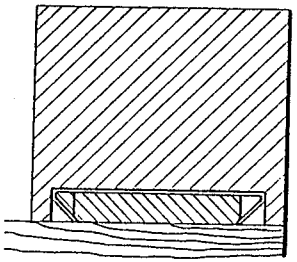
FIG. 17 is a sectional view taken along the line 17—17 of FIG. 15.

In addition, the method of locking the closer body 20 on the bracket 10 against sliding movement therebetween may be also changed. Instead of lugs 103 and holes 204, referring to FIG. 12, one side wall of the closer body 20 may be formed with a first through hole h1 which is communicated with one groove 203 and which engages with a first lock bolt 50' engaging threadably with a first threaded hole H1 provided in the end surface of one tongue 102. Alternatively, referring to FIG. 13, one tongue 102 may be formed with a second threaded hole H2 extending in a direction perpendicular to that of the first threaded hole H1, while a wall of the closer body 20 is formed with a second through hole h2 which is communicated with one groove 203 and which extends in a direction perpendicular to that of the first through hole h1, so that the closer body 20 can be locked on the bracket 10 by a second lock bolt 50''.

Or, referring to FIGS. 14 through 17, the L-shaped tongues 102 and the rectangular grooves 203 may be replaced with tapered tongues 102' and grooves 203'. In this alternative embodiment, one end surface of the bracket 10 has two screw holes 104', while the corresponding side wall of the closer body 20 has two holes 204' for screwing the closer body 20 to the bracket 10.

With the present invention thus explained, it is apparent that various modifications and variations can be made without departing from the scope and spirit of the present invention. It is therefore intended that the present invention be limited only as indicated in the appended claims.

I claim:

1. A door closer to be mounted on a door for applying a torque to return the door to a closed position comprising a plate-shaped mounting bracket adapted to be fixed on the door, and a closer body secured detachably to said bracket and having a housing which has an opening for receiving said bracket therein;

said bracket being smaller than said opening of said closer body in size so as to be completely concealed by said closer body, said bracket having two opposed first sides and two opposed second sides interconnecting said first sides, each of said first sides having tongues which are longitudinally spaced apart from each other and which extend inwardly and laterally relative to said housing, said tongues having straight end edges which extend in a predetermined direction, one of said second sides of sad bracket having a lug which extends inwardly of said housing and which has a first screw hole; and said closer body having two opposed first side walls and two opposed second side walls interconnecting said first side walls, each of said first side walls having longitudinally spaced-apart inwardly projecting surfaces; any adjacent two of said projecting surfaces defining a space therebetween to allow access of a corresponding said tongue, each of said projecting surfaces having a groove which extends in said predetermined direction to communicate with a corresponding said space and which is well-matched with said end edge of a corresponding said tongue, one of said first and second side walls being adjacent to said first screw hole of said bracket and including a first bolt and a second hole which is aligned with said first screw hole for screwing said closer body to said bracket by said first bolt while permitting said lug to abut against an inner wall of said closer body, said first bolt extending in a direction parallel to said bracket.

2. A door closer as claimed in claim 1, wherein said bracket includes a plurality of second bolts and third holes for screwing said bracket to the door by said second bolts.

3. A door closer as claimed in claim 1, wherein said tongues of said bracket are tapered.

4. A door closer as claimed in claim 1, wherein said tongues of said bracket are L-shaped.

5. A door closer as claimed in claim 1, wherein all of said tongues and said grooves are in line with one another.

* * * * *